United States Patent [19]

Müller

[11] 4,169,556

[45] Oct. 2, 1979

[54] FLAT JET DISCHARGE DEVICE FOR A MIXTURE OF A PRESSURIZED LIQUID WITH SOLID PARTICLES

[75] Inventor: Horst Müller, Duisburg, Fed. Rep. of Germany

[73] Assignee: Myers-Europe GmbH, Essen, Fed. Rep. of Germany

[21] Appl. No.: 846,763

[22] Filed: Oct. 31, 1977

[30] Foreign Application Priority Data

Oct. 26, 1976 [DE] Fed. Rep. of Germany ..... 2648445

[51] Int. Cl.[2] ..... B05B 7/14

[52] U.S. Cl. ..... 239/434; 239/597

[58] Field of Search ..... 239/433, 434, 592–595, 239/597

[56] References Cited

U.S. PATENT DOCUMENTS

| | | | |
|---|---|---|---|
| 1,036,638 | 8/1912 | Kelley | 239/434 X |
| 2,387,193 | 10/1945 | Swenarton | 51/439 X |
| 2,605,596 | 8/1952 | Uhri | 51/439 X |
| 2,606,073 | 8/1952 | Uhri | 51/439 X |
| 3,032,275 | 5/1962 | Schneider | 239/592 X |
| 3,994,097 | 11/1976 | Lamb | 51/439 X |

*Primary Examiner*—John J. Love

*Attorney, Agent, or Firm*—Burns, Doane, Swecker & Mathis

[57] ABSTRACT

A jet discharge device comprises separate inlets for liquid and solid particles and a tubular mouthpiece of flat cross-sectional shape in which the solid particles and liquid are to be mixed and ejected from a front face of the mouthpiece. Wear of narrow side walls of the mouthpiece is minimized by locating the solid particle inlet completely within the lateral boundaries of the liquid jet formed within the mouthpiece and by arranging the liquid nozzle so that most, if not all, of the liquid jet is spaced from the narrow side walls. Wear of the narrow side walls is also minimized by providing auxiliary liquid jets along the narrow side walls to restrict engagement of solid particles therewith.

5 Claims, 6 Drawing Figures

Figure 1:
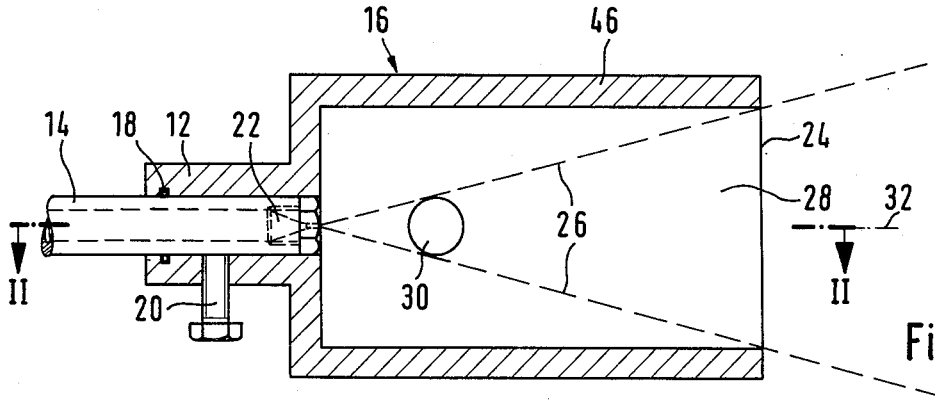

FLAT JET DISCHARGE DEVICE FOR A MIXTURE OF A PRESSURIZED LIQUID WITH SOLID PARTICLES

BACKGROUND OF THE INVENTION

FIELD OF THE INVENTION

As is well-known a pressurized liquid jet mixed with solid particles is suitable for use in the removal of rust and scale from rolling mill products and of the cores from castings as well as for cleaning purposes of the most varied kind and also for surface matting. The pressurized liquid most frequently used is water under pressure of from 1450 to 8700 p.s.i. (100 to 600 bar). Suitable solids to be admixed depend on the original nature and desired final quality of the surfaces to be treated and may be, for example, aluminum slag, quartz sand, quartz powder, or chalk which are mixed with the pressurized liquid either in the form of powder or as a slurry.

Some of the work described, such as the rust removal or descaling of sheet metal is best performed by means of a flat section jet of the mixture of pressurized liquid and solid particles. Yet so far no suitable flat jet discharge device has been available for such purposes.

SUMMARY OF THIS INVENTION

It is an object of the present invention to provide a flat jet discharge device of the kind specified by means of which a clearly defined, flat jet of a mixture of pressurized liquid and solid particles can be generated and which, at the same time, is subject to little wear only.

In accordance with the invention, in a flat jet discharge device for a mixture of a pressurized liquid with solid particles, comprising a connecting socket for a liquid conduit, an inlet for solid particles, and a tubular mouthpiece of flat cross sectional shape said connecting socket for said liquid conduit includes a nozzle aranged coaxially with said mouthpiece and forming a liquid jet which spreads within the mouthpiece, and said inlet for solid particles is disposed at a broad side of the mouthpiece in an area in which the projection of the inlet on a central plane of the mouthpiece parallel to the broad sides lies within the projection of said liquid jet on the central plane.

This largely prevents the solid particles entrained by the liquid jet from getting into contact with the inside walls of the mouthpiece. This affords good protection of the mouthpiece from wear and over long priods of operation the mouthpiece warrants a sharp delimitation of the issuing jet.

Preferably the projection of the inlet on said central plane is located spaced from and within the limits of the projection of the liquid jet on the same central plane. As a consequence, the marginal areas of the liquid jet remain free of any solid particles thus further reducing wear of the mouthpiece.

As an alternative or in addition another liquid nozzle each may be arranged at least at two sides of said nozzle which is coaxial with the mouthpiece. These further liquid nozzles are at least almost parallel to said first nozzle and from marginal jets which flow past the inlet for solid particles at a lateral spacing from the same. Over the entire length of the mouthpiece these marginal jets remain substantially free of solid particles and, thereby, protect the mouthpiece from the abrasive action of the solid particles. Furthermore, the marginal jets may contribute to bundling the liquid jet ejected by the central nozzle and mixed with solid particles, provided they are sufficiently sharply limited themselves.

BRIEF DESCRIPTION OF THE PREFERRED EMBODIMENTS

Figure 2:
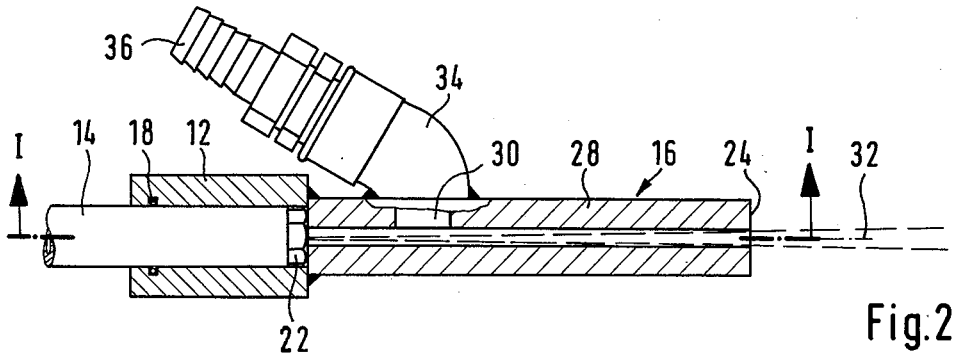
Figure 3:
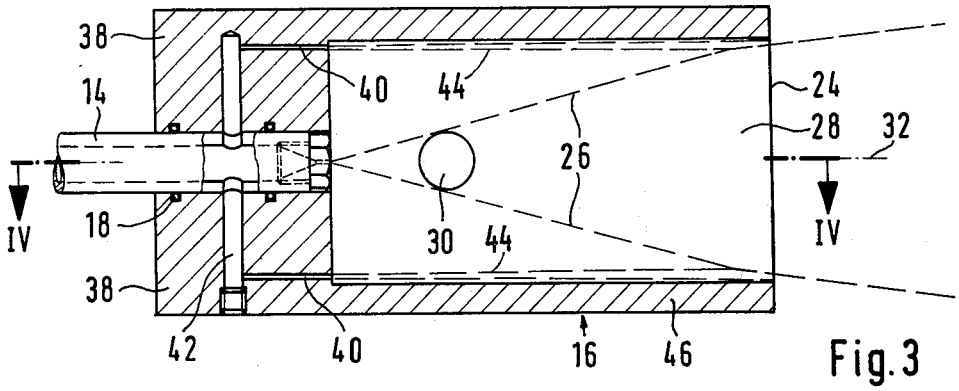
Figure 4:
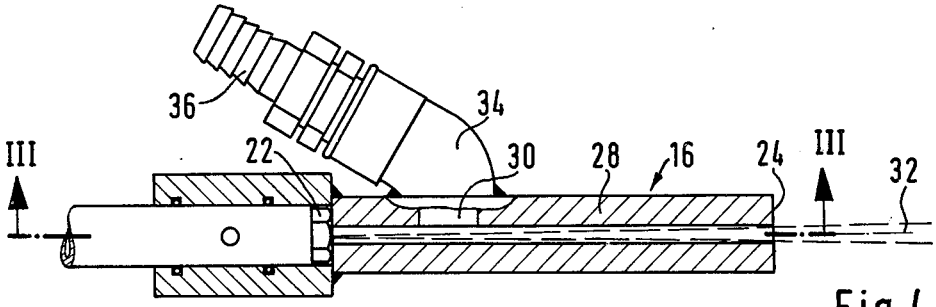
Figure 5:
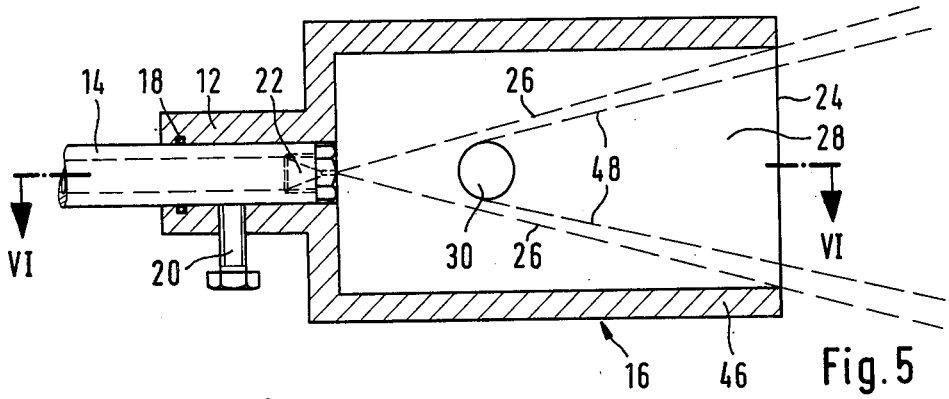
Figure 6:
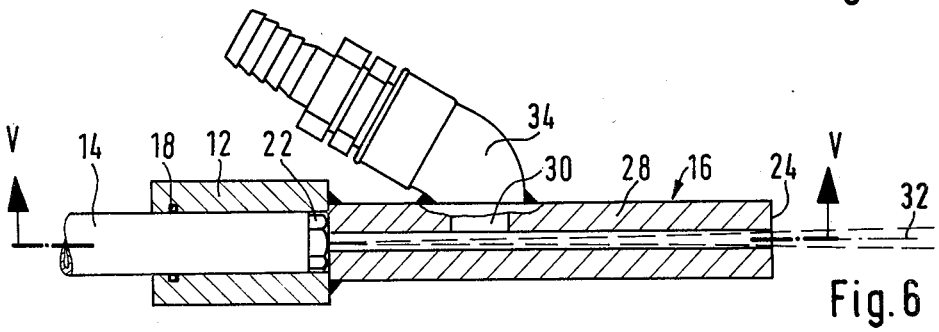

In The Drawings:

FIG. 1 is a cross sectional elevation along line I—I of FIG. 2 of a first embodiment of a flat jet discharge device, FIG. 2 is a cross sectional elevation along line II—II of FIG. 1 of the same flat jet discharge device, FIG. 3 is a cross sectional elevation along line III—III of FIG. 4 of a second embodiment of a flat jet discharge device, FIG. 4 is a cross sectional elevation along line IV—IV of FIG. 3 of the flat jet discharge device, FIG. 5 is a cross sectional elevation along line V—V of FIG. 6 of a third embodiment of a flat jet discharge device, FIG. 6 is a cross sectional elevation along line VI—VI of FIG. 5.

The flat jet discharge device shown in FIGS. 1 and 2 comprises a connecting socket 12 for a liquid conduit 14 arranged coaxially with a tubular mouthpiece 16 which is rectangular in cross section. In the embodiment shown, liquid conduit 14 is inserted in connecting socket 12 and sealed relative to the same by an angular seal 18 and fixed by a clamping screw 20.

A nozzle 22 is screwed into the end of liquid conduit 14 so as to be coaxial with mouthpiece 16 as well. In the embodiment shown, the nozzle is designed as a flat section jet discharge nozzle. The nozzle 22 generates a liquid jet which spreads within mouthpiece 16 and contacts the inner walls of the same only close to the free front face 24 of the mouthpiece, as shown by the lateral delimitations 26 of the liquid jet in FIG. 1 facing the narrow sides of the mouthpiece.

One of the broad sides 28 of mouthpiece 16 comprises an inlet 30 for solid particles. In the embodiment shown, this inlet has a circular cross section. The projection of the inlet 30 on the central plane 32 of mouthpiece 16, which plane is the plane of the drawings of FIG. 1 and extends parallel to the broad sides 28 of the mouthpiece. Said projection of the inlet 30 lies within the projection of the liquid jet on said central plane, in other words within the lateral delimitations 26 of the liquid jet.

A pipe elbow 34 is fixed above the inlet 30 at the respective broad side 28 of mouthpiece 16. In the embodiment shown, it is fixed by welding. A solid particle line may be connected to this pipe elbow. The drawing shows only a connecting piece 36 thereof joined by a screw connection with pipe elbow 34.

The flat jet discharge devices shown in FIGS. 3 to 6 comprise the same structural elements as those described with reference to FIGS. 1 and 2 and therefore these structural elements are designated by the same reference numerals in FIGS. 3 to 6.

The flat jet discharge device according to FIGS. 3 and 4 differs from the embodiment shown in FIGS. 1 and 2 in that the connecting socket 12 comprises two lateral extensions 38 each provided with an additional liquid nozzle 40 extending parallel to the common axis of connecting circuit 12 and mouthpiece 16. The additional liquid nozzles 40 are connected to liquid conduit 14 through a transverse bore 42.

The additional liquid nozzles 40 each produce an additional liquid jet 44 flowing along the narrow sides 46 of mouthpiece 16 remote from the inlet 30 for solid particles and deflecting the central liquid jet formed by nozzle 22 from said narrow sides 46. This is indicated in FIG. 3 by a bent course of the delimitations 26 of the central liquid jet.

In this manner the solid particles are kept away from the narrow sides 46 of mouthpiece 16. The flat jet discharge device according to FIGS. 5 and 6 differs from the embodiment shown in FIGS. 1 and 2 in that the inlet 30 for solid particles and consequently also pipe elbow 34 are arranged at a smaller distance from the front face 24 of mouthpiece 16 so that the projection of inlet 30 on the central plane 32 lies spaced from and within the delimitations 26 of the liquid jet. As a consequence of the spacing of the inlet 30 for solid particles from the delimitations 26, shown in FIG. 5, the liquid jet which has been formed by nozzle 22 and has flown past inlet 30 has marginal zones 48 close to its delimitations 26 which are free of solid paritcles. This is another means of keeping the solid particles away from the narrow sides 46 of mouthpiece 16.

There is especially little wear at the narrow sides 46 in the case of the embodiments according to FIGS. 3 and 4 as well as 5 and 6 in spite of the considerable size of the angle between the delimitations 26 of the central liquid jet. The features described in connection with FIGS. 3 and 4 as well as 5 and 6 may also be provided in combination in a flat jet discharge device.

Wear at the broad sides 28 of the mouthpiece 16 is less critical because the central liquid jet spreads at a much smaller angle in the direction of these broad sides, as may be gathered from FIGS. 2, 4, and 6. However, if also the broad sides 28 are to be protected from the solid particles, additional liquid nozzles similar to liquid nozzles 42 may be provided to produce additional marginal jets which flow along the broad sides 28.

Irrespective of the features described for protection of the narrow sides and, if desired, also of the broad sides 28 the inside of mouthpiece 16 may have an abrasion protection coating, for example, of an elastomer.

What is claimed is:

1. A flat jet discharge device for a mixture of a pressurized liquid with solid particles, comprising a connecting socket for a liquid conduit, an inlet for solid particles, and a tubular mouthpiece of flat cross-sectional shape, said mouthpiece having two broad sides and two narrow sides extending forwardly toward a front face, and a central plane parallel to the broad sides, wherein said connecting socket for said liquid conduit includes an internal nozzle arranged coaxially with said mouthpiece and defines lateral delimitations facing the narrow sides of the mouthpiece, at least the portions of said jet located rearwardly of the vicinity of said front face being spaced from said broad and narrow sides, and wherein said inlet for solid particles is disposed at one of said broad sides of said mouthpiece in an area in which the projection of the inlet on said central plane of the mouthpiece lies completely within said lateral delimitations of said liquid jet when viewed in a direction perpendicular to said central plane.

2. The flat jet discharge device as claimed in claim 1, wherein said projection of said inlet on said central plane is spaced inwardly from the lateral delimitations of said liquid jet.

3. The flat jet discharge device as claimed in claim 1, wherein additional liquid nozzles are arranged at least at two sides of said first-named nozzle, which is coaxial with said mouthpiece, to form marginal jets flowing past said inlet for solid particles and laterally spaced from the same.

4. The flat jet discharge device as claimed in claim 1 wherein said nozzle is located at an inner end of said mouthpiece, said nozzle including a liquid jet discharge outlet which has a first dimension lying in said central plane and disposed perpendicular to the axis of said mouthpiece, said first dimension being smaller than the dimension between said narrow sides at said inner end of said mouthpiece, said jet discharge outlet having a second dimension disposed perpendicular to said central plane, said second dimension being smaller than the dimension between said broad sides at said inner end of the mouthpiece.

5. A flat jet discharge device for a mixture of a pressurized liquid with solid particles, comprising a connecting socket for a liquid conduit, an inlet for solid particles, and a tubular mouthpiece of flat cross-sectional shape, said mouthpiece having two broad sides and two narrow sides and a central plane parallel to the broad sides, wherein said connecting socket for said liquid conduit includes a nozzle arranged coaxially with said mouthpiece and forming a liquid jet which spreads within the mouthpiece, wherein said inlet for solid particles is disposed at one of said broad sides of said mouthpiece in an area in which the projection of the inlet on said central plane of the mouthpiece lies at least partially within the projection of said liquid jet on said central plane, and additional liquid nozzles are arranged at least at two sides of said first-named nozzle, which is coaxial with said mouthpiece, to form marginal jets flowing past said inlet for solid particles and laterally spaced from such inlet.

* * * * *